United States Patent [19]

Kamada

[11] Patent Number: 4,679,034

[45] Date of Patent: Jul. 7, 1987

[54] INFRARED INTRUSION SENSOR WITH PRELIMINARY AND PRIMARY ALARMS

[75] Inventor: Daikichi Kamada, Osaka, Japan

[73] Assignee: Kamada Signal Appliances Co., Ltd., Osaka, Japan

[21] Appl. No.: 765,947

[22] Filed: Aug. 14, 1985

[51] Int. Cl.[4] ..... G08B 13/18

[52] U.S. Cl. ..... 340/567; 340/529; 340/691

[58] Field of Search ..... 340/567, 691, 541, 529, 340/530

[56] References Cited

U.S. PATENT DOCUMENTS

| | | | |
|---|---|---|---|
| 3,703,718 | 11/1972 | Berman | 340/567 |
| 4,047,165 | 9/1977 | Andreasson et al. | 340/691 |
| 4,103,285 | 7/1978 | Lloyd et al. | 340/529 |

*Primary Examiner*—Glen R. Swann, III

*Attorney, Agent, or Firm*—Koda and Androlia

[57] ABSTRACT

An intrusion alarming apparatus according to this invention detects the human body present in a sensing zone thereof and sends out warning information by means of sound and light. Detection of the human body depends on a human body sensor which emits detection signals in response to variation in the strength of heat rays or interception of radiated infrared rays. Information by the use of sound and light is effected by driving a sound-using alarm such as a speaker and a light-using alarm such as a stroboscope with a sound emission driving circuit and a light emission driving circuit which operate on the basis of detection signals output by the human body sensor. The driving circuits for sound and light emission are connected to each other so as to be operated by means of a single timer circuit.

5 Claims, 8 Drawing Figures

INFRARED INTRUSION SENSOR WITH PRELIMINARY AND PRIMARY ALARMS

FIELD OF THE INVENTION

This invention relates to an intrusion alarming apparatus used mainly for management of household in general or building.

DESCRIPTION OF THE PRIOR ART

Generally, conventional intrusion alarming apparatuses for such purpose as above have been fabricated so as to buzz when any body intercepts radiated infrared rays. However, these apparatuses have suffered from problems such as described below. When an infrared ray alarm is installed on the fence of a house, buzz is emitted by even only a cat climbing the fence. At this time, if none of families are present in the house, improper buzz is continuously emitted and extremely annoys neighbors. As another problem, buzz is emitted every time when a bird or ball flies across infrared rays, thereby causing more frequent emission of improper alarm. It is also a problem that alarm by sound only is hard for a person weak in hearing power.

SUMMARY OF THE INVENTION

This invention was initiated in view of the above problems and an object thereof is to provide an intrusion alarming apparatus whose sound emitting body is controlled not to continuously emit improper buzz when sensing a human body or other foreign matter entering the sensing range thereof by providing signals which adapt the sound emitting body and light emitting one to operate in association with each other, or an alarming apparatus enabling even a person of weak hearing power to readily catch alarming information.

DETAILED DESCRIPTION OF THE INVENTION

Figure 1:
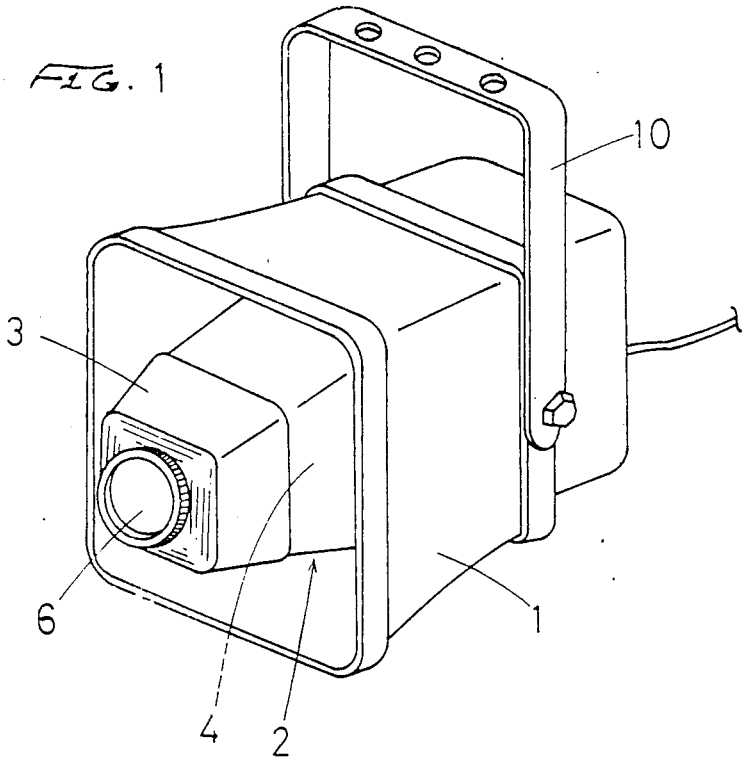
FIG. 1 is a perspective view of an alarming apparatus according to this invention.
Figure 2:
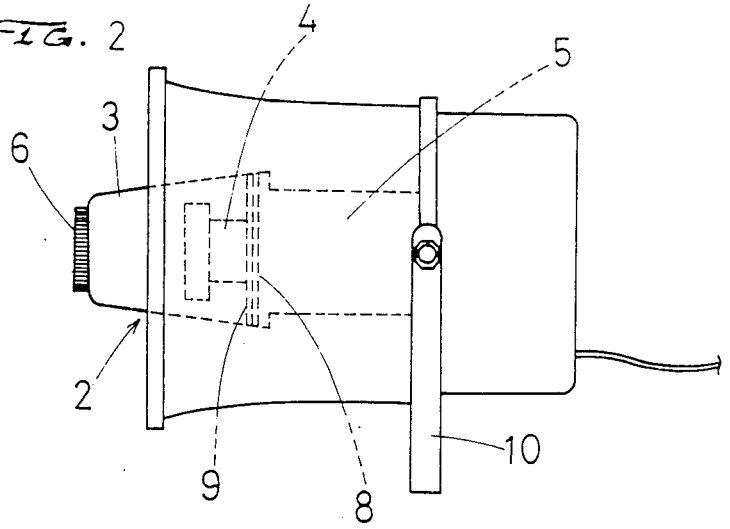
FIG. 2 is a side view thereof.

In FIGS. 1 and 2, the reference numeral 1 indicates a main body case which opens at one side and is internally provided with an informing mechanism unit 2. This informing mechanism unit 2 comprises a light emitting informing body 4 enclosed by a cover 3 made of translucent acrylic resin, a sound emitting informing body 5 fixed in the rear of the light emitting informing body 4, and a human body sensor 6 mounted on the tip of the abovesaid cover 3, a part of the cover 3 being outwardly protruded from the opening part of the case 1. The light emitting informing body 4, sound emitting informing body 5, and human body sensor 6 comprise a stroboscope, speaker, and heat ray sensor, respectively, the heat ray sensor sensing variation in the strength of radiant heat from the human body, that is, heat rays or infrared rays having a wavelength specific to the human body, when the human body enters the sensing range of 7 m in radius and causes variation in the strength of heat rays.

The numerals 8, 9, and 10 in FIG. 2 represent a base plate to which the light emitting informing body 4 is fixed, a reflector plate, and a lever for fixing the case 1, respectively.

Figure 3:
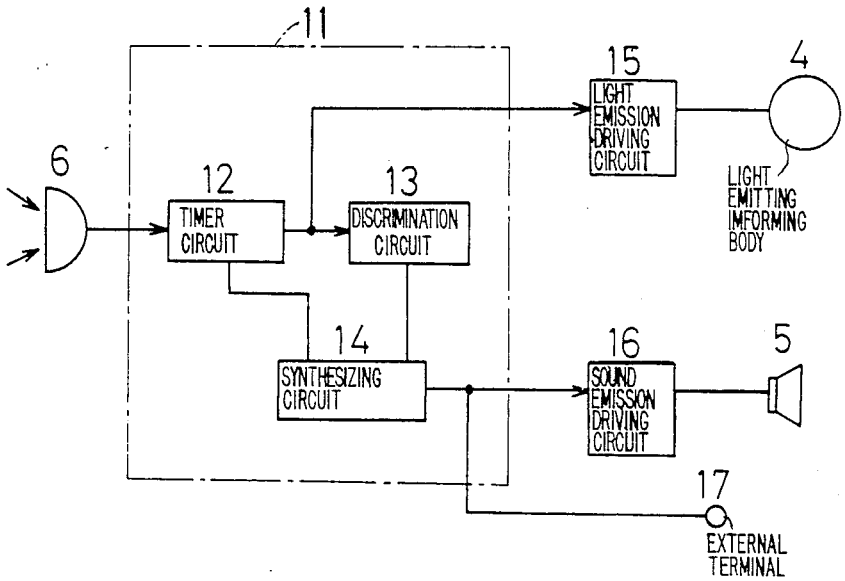
FIG. 3 is a block diagram thereof.

A block diagram of FIG. 3 showing an example of internal electrical mechanism in the above structure will be described.

Figure 4:
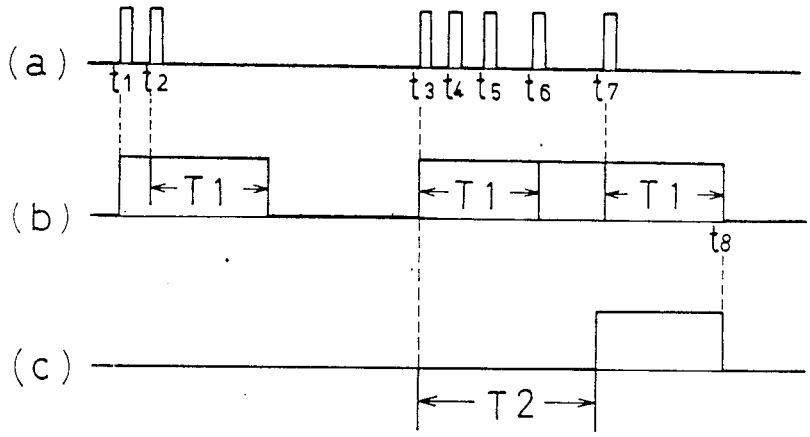
FIG. 4 is a timing chart thereof.

The human body sensor 6 emits detection signals as shown in FIG. 4(*a*) every time when sensing variation in the strength of heat rays caused by the movement of the human body. The numeral 11 designates a control unit to adapt the light emission driving circuit and sound emission circuit that will be described later to operate in association with each other, and comprises a timer circuit 12, discrimination circuit 13, and synthesizing circuit 14.

The timer circuit 12, as shown in FIG. 4(*b*), is endowed with a re-triggerable function by which the timer circuit 12 is actuated upon input of detection signals emitted from the human body sensor, re-actuated when detection signals are re-input within a lapse of predetermined time $T_1$, and again a certain length of time $T_1$ is set, whereby actuation is seemingly continuously performed as far as detection signals are input within a lapse of set time $T_1$.

The discrimination circuit 13, as shown in FIG. 4(*c*), detects the output from the timer circuit 12 when the output continues for a certain predetermined time $T_2$, and emits output corresponding to the detected output.

The synthesizing circuit 14 outputs power only when both the timer circuit 12 and the discrimination circuit 13 output power. In other words, this circuit 14 outputs power during a period from the time $t_7$ shown in FIG. 4(*a*) when power is output from the discrimination circuit 13 to the time $t_8$ when the timer circuit 12 stops outputting power.

The numeral 15 indicates a light emission driving circuit for lighting and rotating the light emitting informing body 4 for emitting preliminary warning with light emitting means such as a stroboscope, the circuit being driven by the output of the timer circuit 12 as shown in FIG. 4(*b*).

The numeral 16 represents a sound emission driving circuit for adapting the sound emitting informing body 5 which emits main alarm by sound emission means such as a speaker to emit buzz or siren sound, the circuit being driven by output signals from the synthesizing circuit 14.

The numeral 17 indicates an external terminal introduced from the synthesizing circuit 14 and used as an auxiliary terminal for driving other apparatus to actuate an automatic communication mechanism connected to, for example, the police station directly or through an other timer circuit.

The action of an intrusion alarming apparatus embodying this invention and fabricated as above is such that, when an intruder enters the sensing range of the human body sensor 6 directed toward a crime rejection area at the time $t_1$ as shown in FIG. 4, the timer circuit 12 is actuated, as shown in FIG. 4(*b*), by detection signals emitted due to radiant heat from the intruder and thereby the light emitting informing body 4 is driven to emit light as preliminary warning. At this time, if the intruder immediately disappear from the area at the time $t_2$, the light emitting informing body 4 automatically stops operating after a lapse of time $T_1$ from the time $t_2$. That is to say, when the intruder disappear from the area after a lapse of short time or a dog or cat crosses the crime rejection area, only preliminary warning with light emission is emitted.

When the intruder again enters the crime rejection area and continues to stay there even after a lapse of time $T_1$ set in the timer circuit 12, variation in the strength of heat rays caused by behavior of the intruder, for example, the motion of hands of the intruder, emits detection signals at the times $t_4$, $t_5$, and $t_6$, whereby the timer circuit 12 is correspondingly actuated, the light emitting informing body 4 is continuously driven to emit warning light, and, after a lapse of time $T_2$ set in the discrimination circuit 13, the sound emitting informing body 5 emits alarming sound. When the intruder surprised at alarming sound escapes from the area, both the light emitting informing body 4 and sound emitting one 5 are automatically stopped at the time $t_8$ after a lapse of time $T_1$ set in the timer circuit 12.

Thus, an apparatus according to this invention, when detecting the intruder, gives preliminary warning with light emission to the intruder first and, when the intruder disappear from the area at once in submission to warning, stops emitting warning after a lapse of a certain time from the escape of the intruder, whereas it continues to give preliminary warning when the intruder does not disappear from the area, whereby, differently from the conventional apparatus which emits alarming sound at once when detecting the human body or other foreign matter, false alarm caused by a dog or cat crossing the sensing zone or a foreign matter flying across this zone can completely be prevented and no alarm other than preliminary warning is emitted when the intruder disappear from the sensing zone in a short period of time after intrusion. When the intruder continues to stay in the sensing zone for a time longer than predetermined, the apparatus of this invention emits alarming sound for effectuating crime prevention function endowed thereto. Preliminary warning by light emission and main alarm by sound emission are automatically stopped if only the intruder disappear from the sensing zone, thereby no neighbors being annoyed even when none of families are present in the house.

This invention is not limited to the abovedescribed embodiment and a variety of modifications thereof, for example, the use of the conventional type infrared ray sensor or vibration sensing mechanism as a human body sensor, may be considered without departing from the scope of claims.

Intermittent driving of the light emitting informing body corresponding to every input of detection signals while excluding the timer circuit 12 in the control unit is possible, which may be more effective for giving warning to the intruding dog or cat. In this case, such a structure of discrimination circuit as counting the frequency of driving the light emitting informing body and as driving the sound emitting informing body upon sensing the frequency reaching a certain number within a certain length of time may fulfil the purpose.

Figure 5:
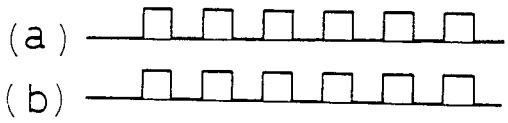
FIGS. 5 and 6 are timing charts showing combinations of sound and light; and, FIGS. 7 and 8 are views of appearance of alarming apparatuses as other embodiments of this invention.
Figure 6:
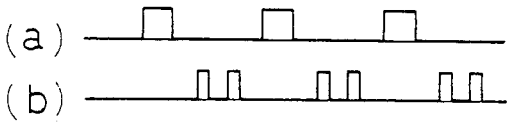
Figure 7:
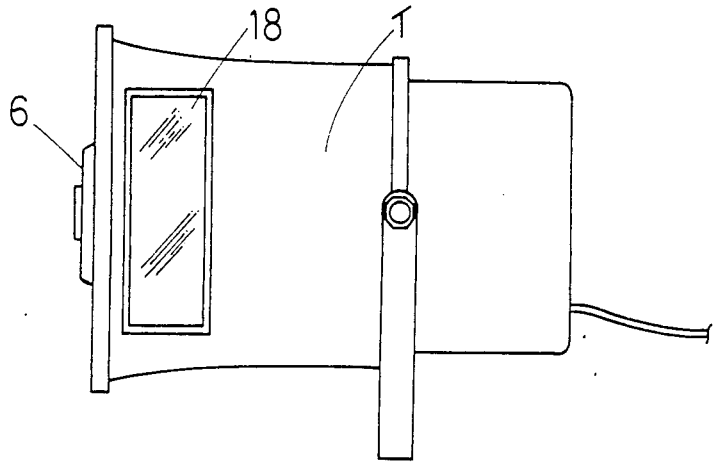

The control unit in the alarming apparatus of this invention is structurally not limited to separate use of light emission information and sound emission information for preliminary warning and main alarm, respectively, and may be of such structure that the light emission drive circuit and sound emission one are controlled in association with each other, for example, as shown in FIGS. 5(*a*) and 5(*b*), simultaneous emission of driving signals from the light emission circuit 15 with that from the sound emission driving circuit 16, or, as shown in FIGS. 6(*a*) and 6(*b*), alternate emission of driving signals from the light emission circuit 15 and sound emission one 16 for communication of signals through visual sense and acoustic sense which permits sure confirmation of alarm even when the level of sound is low. Various combinations of ways of outputting light and sound in the control unit are applicable to many kinds of alarming systems in the public or welfare facilities.

The kind of light emitting informing body as well as that of sound emitting one is also not limited to the embodiment and the order to use preliminary warning and main alarm may be reverse.

Further, this invention can meet general purpose other than that for crime prevention, for example, when applied to watch for men entering the dangerous zone, no alarm is given if they carelessly enter the zone whereas main alarm is emitted only when they do so intentionally.

The embodiment is fabricated in appearance so that a transparent cover 3 composing the informing mechanism unit 2 projects from the case 1 and light emission can visually be observed from all sides except the rear one, however, the same effect can be obtained when transparent windows 18, each having a transparent material fitted thereinto, are provided on some of peripheral sides of the case 1' (four sides in the drawing, because the case 1 is square when viewed from the front side) as shown in FIG. 1, and the informing mechanism unit can advantageously be contained in the case 1' of the main body.

Figure 8:
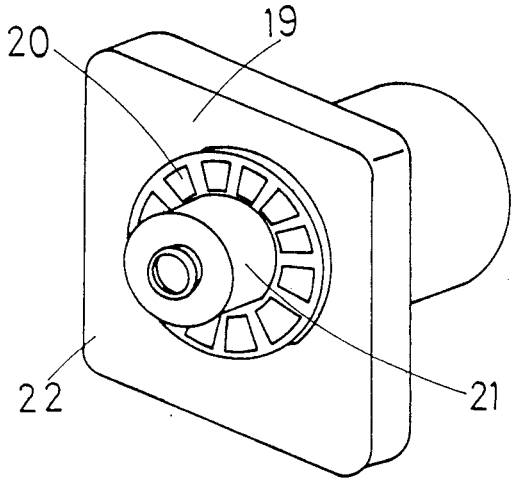

An apparatus of this invention, when intended to be fixed to a panel of the control board or alarm board, may be fabricated in such manner that, as shown in FIG. 8, a light emitting informing body 21 covered with a transparent cover is projected from the central part of a sound emitting informing body 20 incorporated into the main body case 19 to be fitted in the front face of the panel and the human body sensor 22 is mounted on the tip of the light emitting informing body 21.

As has been described heretofore, according to an alarming apparatus of this invention which emits alarm and signals utilizing sound and light, precise and versatile informing means can be obtained by controlling in various ways combination of sound and light, and information can surely be communicated to the person weak in hearing power. The structure permitting visual confirmation of light signals from all sides serves as sure information means. A structural combination of the light emitting informing body which also emits alarming sound and the sound emitting informing body provides an apparatus which is compact and refined in design.

As can be understood from the embodiment, in the structure thereof enabling separate use of light emission information and sound emission one for preliminary warning and main alarm, respectively, as well as emission of main alarm after continuation of preliminary warning for a predetermined length of time, preliminary warning is given at first when the human body or other foreign matter enters an area to be watched, no alarm but preliminary warning is emitted when the intruder disappear from the area in a certain fixed period of time with no detection signals input from the sensor, and main alarm is emitted when detection signals are continuously input, whereby emission of the so-called "false alarm" such as exaggerative emission of main alarm for trivial happening as crossing of a dog or cat or flying of a foreign matter in the watched area or caused when the intruder quits the area soon after intrusion in submission to preliminary warning can completely be prevented; the structure proving perfect in respect of crime prevention which is the prime object of the invention because it emits main alarm when the situation conforms to a predetermined one that detection signals are continuously input, and solving at a stroke such problems as annoying neighbors when none of families are present in the house.

What is claimed is:

1. An intrusion alarming apparatus comprising:

a main body case of horn shape having an opening at one end thereof, an infrared ray sensor disposed substantially in the center of the opening of the main body case, a first alarming means for producing preliminary alarm of a predetermined period of time, a second alarming means for producing primary alarm following said preliminary alarm signal, a control unit for receiving an output from said infrared ray sensor, said control unit including a timer circuit having a re-triggerable function, a discrimination circuit and synthesizing circuit, whereby preliminary alarm is produced upon detecting an intrusion and primary alarm is followed only if such intrusion continues for a predetermined period of time.

2. The alarming apparatus as defined in claim 1 wherein said first alarming means is a light emitter, said second alarming means is a sound producer.

3. The alarming apparatus as defined in claim 2 further comprising an auxiliary terminal connected to said synthesizing circuit for driving another apparatus.

4. The alarming apparatus as defined in claim 1 wherein said synthesizing circuit is directly connected to said discrimination circuit, said discrimination circuit is constructed to output when the output of said timer circuit continues for a second predetermined time and said synthesizing circuit is constructed to output when it receives both of the outputs of the discrimination circuit and said timer circuit at the same time, whereby said light emitter is driven by the output of the timer circuit and said sound producer is driven by the output of the synthesizing circuit.

5. The alarming apparatus as defined in claim 2 wherein said light emitter is a stroboscope which is disposed rearwardly of the infrared ray sensor and housed in a semitranslucent cover, and wherein said sound producer is a speaker which is disposed rearwardly of said stroboscope.

* * * * *